United States Patent [19]

Schellberg et al.

[11] 3,992,829

[45] Nov. 23, 1976

[54] BUILDING STRUCTURE

[75] Inventors: Willis E. Schellberg; Eugene G. Austad; Peter F. Jensen, all of Forest City, Iowa

[73] Assignee: Winnebago Industries, Inc., Forest City, Iowa

[22] Filed: July 14, 1975

[21] Appl. No.: 592,616

[52] U.S. Cl. ..... 52/79; 52/284; 52/271; 52/404; 52/580; 52/753 Y

[51] Int. Cl.[2] ..... E04H 1/12

[58] Field of Search ..... 52/79, 620, 284, 615, 52/270, 271, 753 Y, 753 W, 580, 589, 281, 481, 404

[56] References Cited

UNITED STATES PATENTS

| | | | |
|---|---|---|---|
| 2,129,441 | 9/1938 | Otto | 52/271 X |
| 3,175,940 | 3/1965 | Talmey | 52/615 X |
| 3,561,183 | 2/1971 | Keemer | 52/404 X |
| 3,712,004 | 1/1973 | Loebsack | 52/270 X |

*Primary Examiner*—Price C. Faw, Jr.
*Assistant Examiner*—Carl D. Friedman
*Attorney, Agent, or Firm*—Zarley, McKee, Thomte & Voorhees

[57] ABSTRACT

The building structure of the present invention comprises a rectangular box having ceiling and floor walls and four upstanding walls. The lateral edges of each of the aforementioned walls have L-shaped indentations therein which provide glue surfaces. These L-shaped indentations are mated together at the corner junctions of all walls in the box and are glued together and nailed so as to provide an integral rectangular box. Each wall comprises a plurality of panels joined together in side to side relationship. Each panel comprises spaced apart rigid sheet members, and the panels are joined together in side to side relation by means of elongated stretchers which extend between the spaced apart sheet members and interconnect the panels which are arranged in side to side relationship.

13 Claims, 14 Drawing Figures

BUILDING STRUCTURE

SUMMARY OF THE INVENTION

The present invention relates generally to building structures and specifically to a modular box which may be assembled as a unit and shipped to a construction site for assembly with other similar boxes to provide a complete building. Such boxes are usually finished on the interior thereof so that a minimum of carpentry is required in assembling the various components or boxes at the construction site.

Many attempts have been made to develop a practical modular box for use in construction of homes, apartments, offices and other buildings. However, there have been many problems with developing a complete modular box which will withstand shipping and which may be constructed economically on an assembly line.

The present invention utilizes a unique panel assembly. The assembly includes corner joints which have L-shaped glue surfaces which can be mated together to provide a solid and sturdy corner joint. Furthermore, the panel members of the present invention may be assembled quickly and easily in sturdy side to side relationship so as to provide a wall assembly comprising a plurality of panels.

Therefore, a primary object of the present invention is the provision of a building structure which can withstand shipping by rail or other means with a minimum of damage.

A further object of the present invention is the provision of a building structure which exhibits a minimum of deflection during lifting and moving, even when the structure is grasped at opposite ends thereof and lifted.

A further object of the present invention is the provision of a building structure which minimizes and often eliminates any cracking or disturbance of the interior finished surfaces of the building structure during transportation.

A further object of the present invention is the provision of a building structure which maintains a water tight integrity even after shipping.

A further object of the present invention is the provision of a building structure having panels which may be assembled separately and which will fit together easily when assembled.

A further object of the present invention is the provision of a building structure utilizing joints having glue surfaces which maintain the integrity of the glued joints along their entire lengths.

A further object of the present invention is the provision of a device utilizing joints which may be assembled even though the individual panels may vary slightly in their dimension tolerances.

A further object of the present invention is the provision of a building structure which utilizes a minimum of building materials to provide a maximum of structural integrity and strength.

A further object of the present invention is the provision of a building structure which is economical to assemble and which is economical in the amount of materials which it utilizes.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION OF THE DRAWINGS

Figure 1:
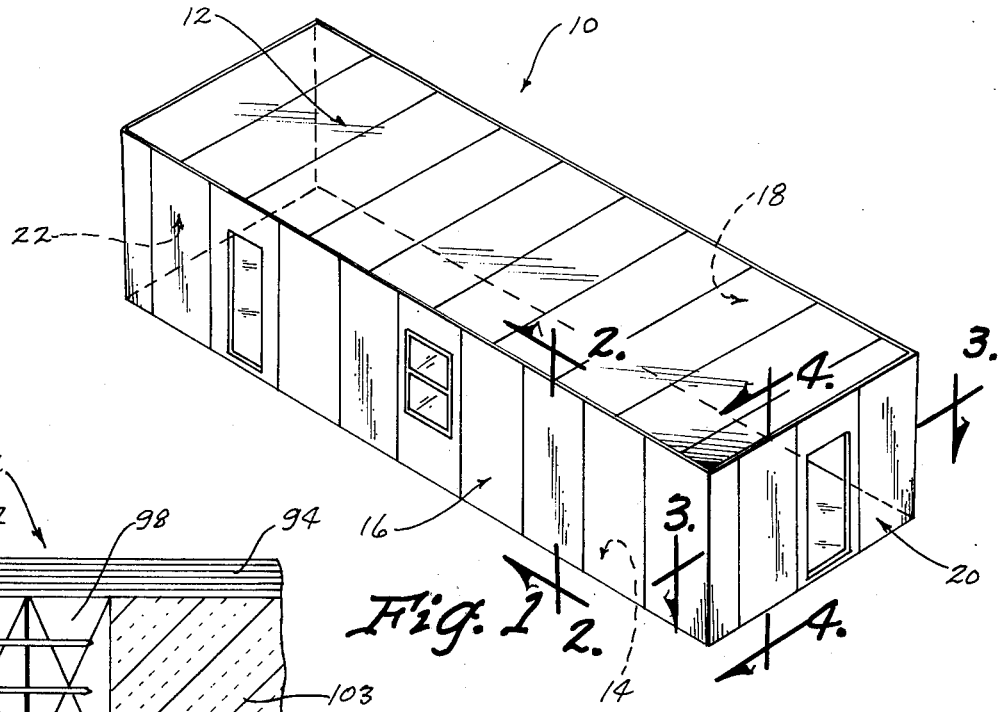
FIG. 1 is a perspective view of the building structure of the present invention.

Referring to the drawings, the building structure of the present invention is generally referred to by the numeral 10. Structure 10 is a rectangular box having a ceiling 12, a floor 14, front and rear walls 16, 18 and end walls 20, 22.

Referring to FIGS. 5–8, walls 16–22 are comprised of a plurality of wall panels 24. Each wall panel includes inner and outer sheet members 26, 28, a frame 30 and a layer of foam insulation 32.

Figure 8:
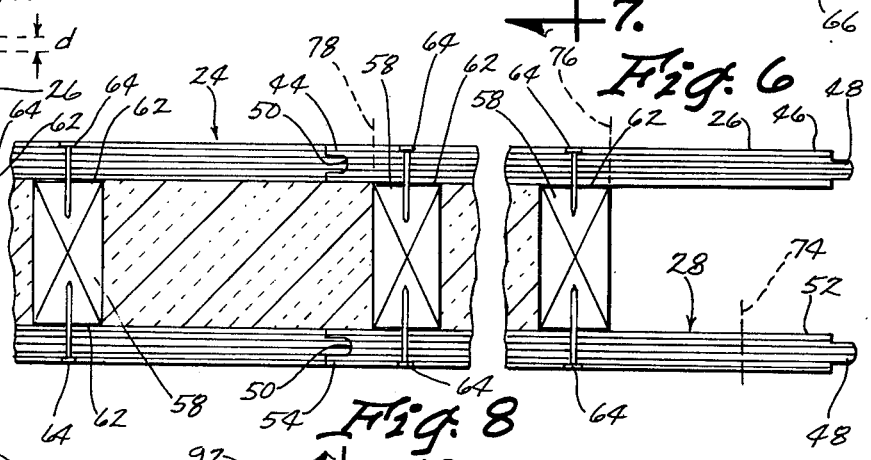

Inner sheet member 26 includes end edges 40, 42 and lateral edges 44, 46. As can be seen in FIG. 8, lateral edges 46 are provided with tongues 48, and lateral edges 44 are provided with grooves 50 which are sized to matingly receive tongues 48.

Figure 7:
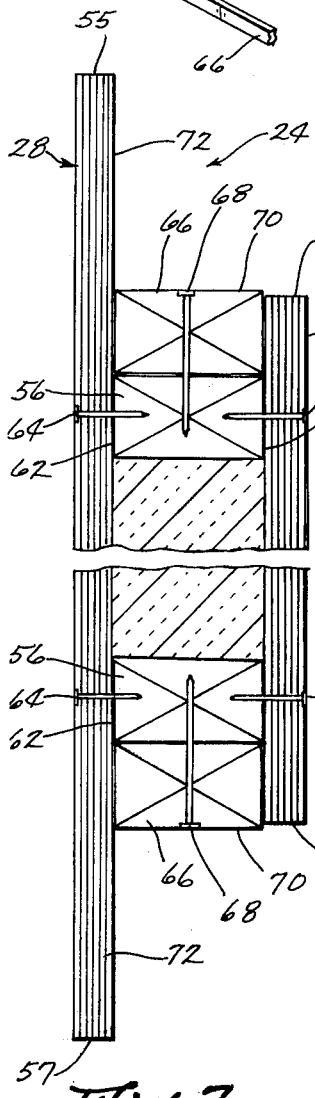
FIGS. 7 and 8 are sectional views taken along lines 7—7 and 8—8 of FIG. 6.

Outer sheet member 28 includes lateral edges 52, 54 which are also provided with tongue 48 and groove 50, respectively. Outer sheet member 28 also includes end edges 55, 57 which extend beyond end edges 40, 42 of inner panel member 26 as shown in FIG. 7.

Frame 30 comprises a pair of parallel and spaced apart panel stretchers 56 and a pair of spaced apart and parallel panel stringers 58 which are interconnected to form a rectangular frame. Panel stringers 58 are spaced inwardly from and extend parallel to the lateral edges 46, 52 and 44, 54 of inner and outer sheet members 26, 28, respectively. Similarly panel stretchers 56 are spaced inwardly from end edges 40, 42 of inner panel 26.

Wall panel 24 is assembled by applying glue to the edges of stretchers 56 and stringers 58 so as to provide a glue line 62 for engaging the sheet members 26, 28. To further secure the attachment of panels 26, 28 to frame 30, a plurality of nails 64 extend through panels 26, 28 into stretchers 56 and stringers 58.

Figure 6:
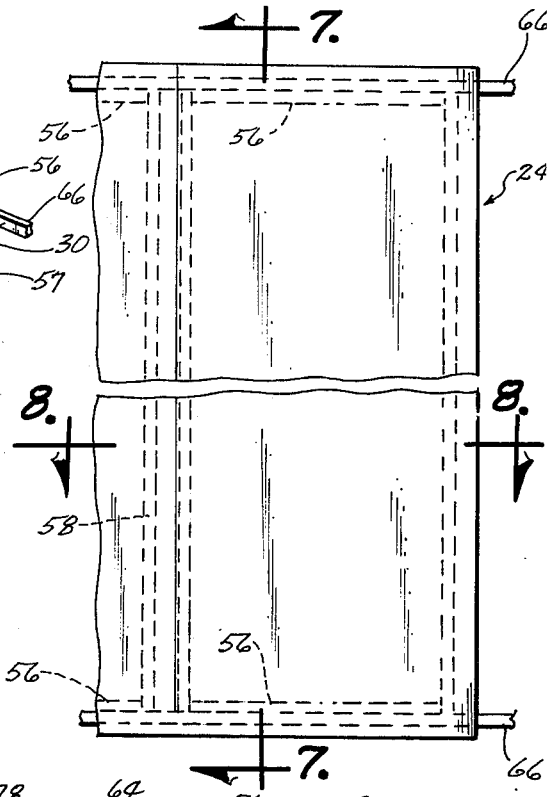
FIG. 6 is a partial view of a wall assembly of the present invention.

In order to assemble a wall assembly for any of walls 16-22, one must place a plurality of wall panels 24 in side to side relationship with tongues 48 presented in facing relationship towards grooves 50 and also with panel stretchers 56 arranged in longitudinal alignment as shown in FIG. 6. Glue is applied to the tongue 48 and groove 50, and clamp means (not shown) are utilized to press tongues 48 into grooves 50 so as to secure wall panels 24 together in side by side relationship. With the clamps still applied a pair of elongated wall stretchers 66 are placed in engagement with the upper and lower panel stretchers 56. Wall stretchers 66 are embraced between sheet members 26, 28 and also engage panel stretchers 56. Glue is applied to the adjoining surfaces of wall stretchers 66 and panel stretchers 56, and then nails or spikes 68 are used to provide further securement therebetween. Once spikes 68 are in place, it is possible to remove these clamps from the wall assembly and wall stretchers 66 will hold the various wall panels 24 together in side by side relationship so that the various wall panels 24 will form a continuous integral wall assembly.

Referring to FIG. 7, a very important feature of the wall stretchers 66 is that they present the corner gluing surface 70 which extends slightly beyond end edges 40, 42 of inner sheet member 26. The distance which surfaces 70 protrude beyond end edges 40, 42 is represented by the letter *d* in FIG. 7. This distance is preferably approximately ⅛ inch. Surface 70 combines with the flange like surface 72 of outer panel 28 to provide an L-shaped gluing surface for receiving the ceiling and floor panels as described hereinafter.

Figure 3:
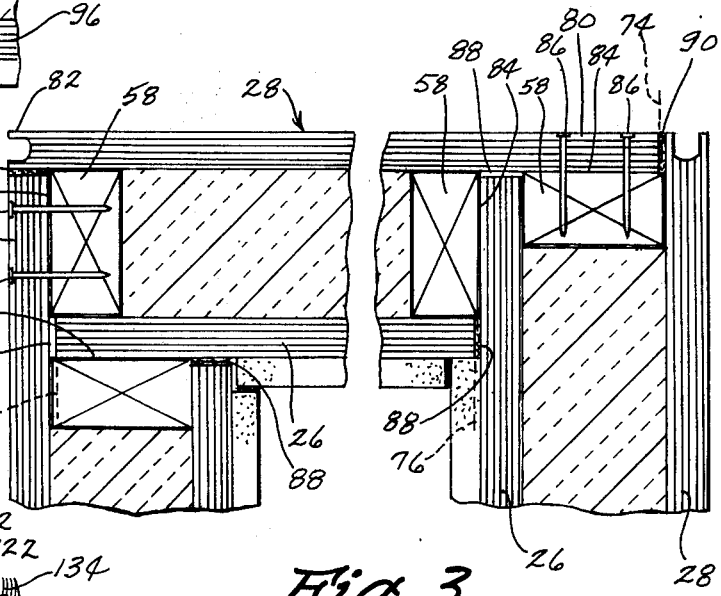

Once wall panels 24 are assembled into a wall assembly, the ends of the wall assembly must be trimmed so that they may be joined to other wall assemblies at right angles. One end of the wall assembly will have a pair of tongues 48 extending outwardly therefrom and the other end of the wall assembly will have a pair of grooves 50 extending outwardly therefrom. Three cuts are made along the lines designated by the numerals 74, 76 and 78, and the resulting wall assembly will have ends which appear as shown in FIG. 3. For clarification, the location of cut lines 74, 76 and 78 are also designated in FIG. 3. As a result of these cuts, outer panel 28 is provided with a long flange 80 at one end and a short flange 82 at the other end. Cuts 76, 78 are made slightly behind the outer edges of panel stringers 58 so as to expose a gluing surface 84 on the outer surfaces of panel stringers 58. The panels are then assembled as shown in FIG. 3 with glue being applied to gluing surfaces 84 and with spikes 86 extending through long flanges 80 into panel stringers 58. It is important to note that inner sheet member 26 is spaced from the adjoining sheet members of the adjoining panels, said spaces being designated by the numerals 88 in FIG. 3. Similarly, the ends of outer panels 28 are also spaced from the adjoining panel members as designated by the numerals 90. Suitable caulking is inserted into spaces 90 so as to prevent moisture from entering from the exterior of structure 10. Because gluing surfaces 84 protrude beyond the edges of inner sheet members 26, it is posssible to apply pressure to the joint during the time that it is being glued so as to insure the integrity of the glue joint along the entire length of stringers 58.

Figure 10:
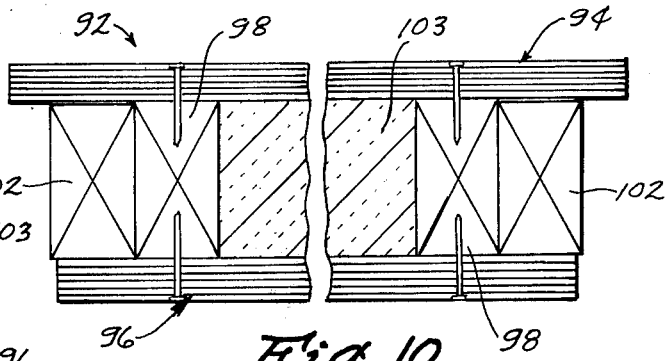
FIGS. 10 and 11 are sectional views taken along lines 10—10 and 11—11 of FIG. 9.
Figure 11:
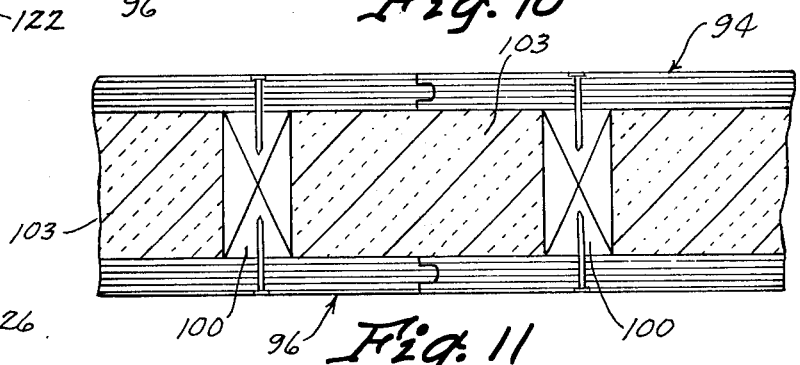
Figure 9:
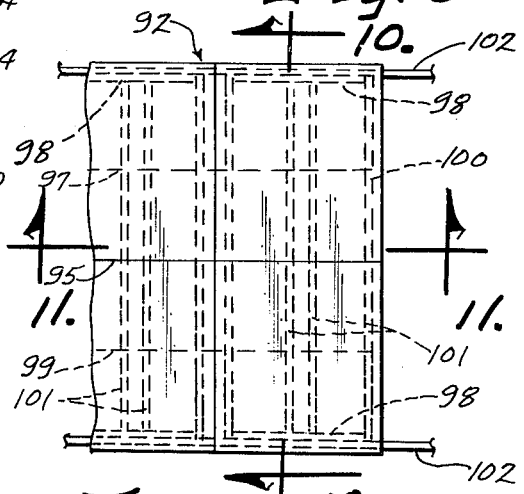
FIG. 9 is a partial plan view of the ceiling wall of the present invention.

Referring to FIGS. 9–11 a ceiling panel is designated by the numeral 92 and includes an outer sheet member 94, an inner sheet member 96, a rectangular frame having panel stretchers 98 and panel stringers 100, and ceiling stretchers 102. Also, a pair of middle stringers 101 are provided in the middle of the rectangular frame. A foam-like insulation material 103 is housed between sheet members 94–96. Ceiling panels 92 are held together by ceiling stretchers 102 in much the same fashion as was previously described for the wall assembly of wall panels 24.

The primary differences between ceiling panel 92 and wall panel 94 are in the dimensions employed, the use of middle stringers 101, and the use of compression and tension seams in sheet members 94, 96. Ceiling panel 92 is preferably slightly thicker in dimension than wall panel 24 so as to be capable of bearing loads at a direction normal to the plane of the panel. Also, as can be seen in FIG. 10, the distance which outer sheet member 94 extends beyond inner sheet member 96 is somewhat less than that shown for wall panel 24 (see FIG. 7). Furthermore, as can be seen by comparison of FIGS. 8 and 11, wall panel 24 is not symmetrical at its ends whereas ceiling panel 92 is symmetrical at its ends.

Sheet members 94, 96 are comprised of a plurality of segments which are joined together in edge to edge relationship so as to form seams 95, 97 and 99 therein. Seam 95 is in outer sheet member 94 and forms a compression seam because of the gravity load of ceiling panel 92. Seams 97 and 99 are tension seams also because of the gravity load on ceiling panel 92.

Figure 12:
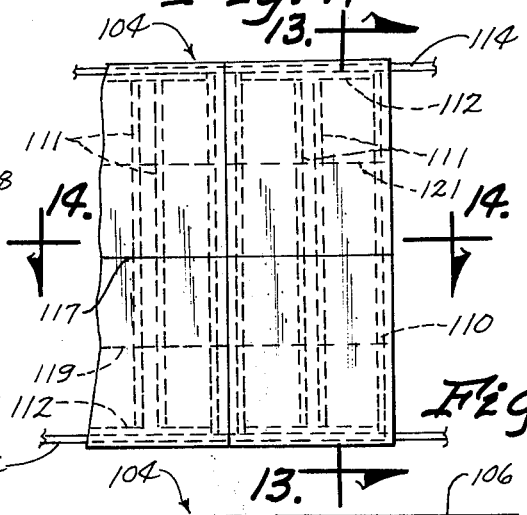
FIG. 12 is a plan view of a floor assembly of the present invention.
Figure 13:
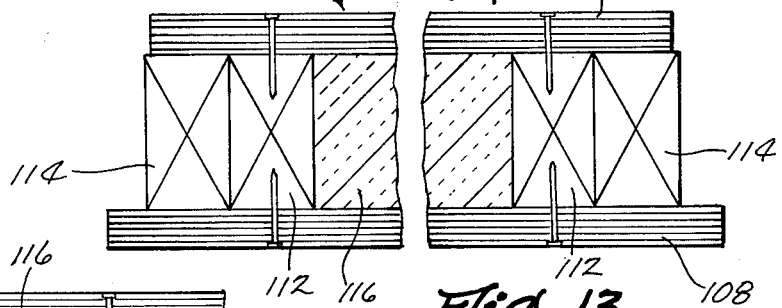
FIGS. 13 and 14 are sectional views taken along line 13—13 and 14—14 of FIG. 12.
Figure 14:
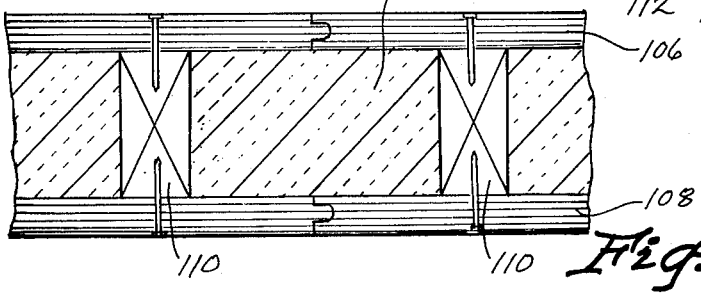
Figure 5:
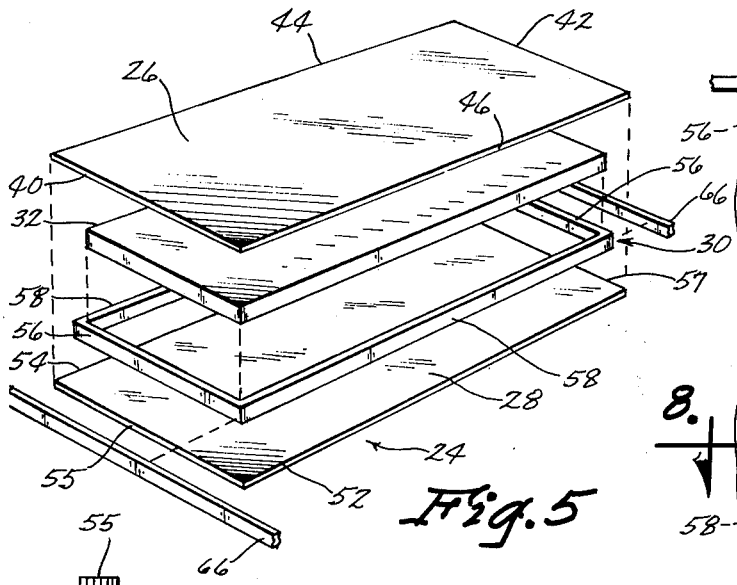
FIG. 5 is a perspective exploded view of a panel of the present invention.

Referring to FIGS. 12–14, the numeral 104 designates a floor panel. Floor panel 104 includes an inner sheet member 106, an outer sheet member 108, panel stringers 110, middle panel stringers 111, panel stretchers 112, and floor stretchers 114. An insulation material 116 is enclosed between sheet members 106, 108. A compression seam 117 is provided in inner sheet member 106 and a pair of tension seams 119, 121 are provided in outer sheet member 108.

Figure 2:
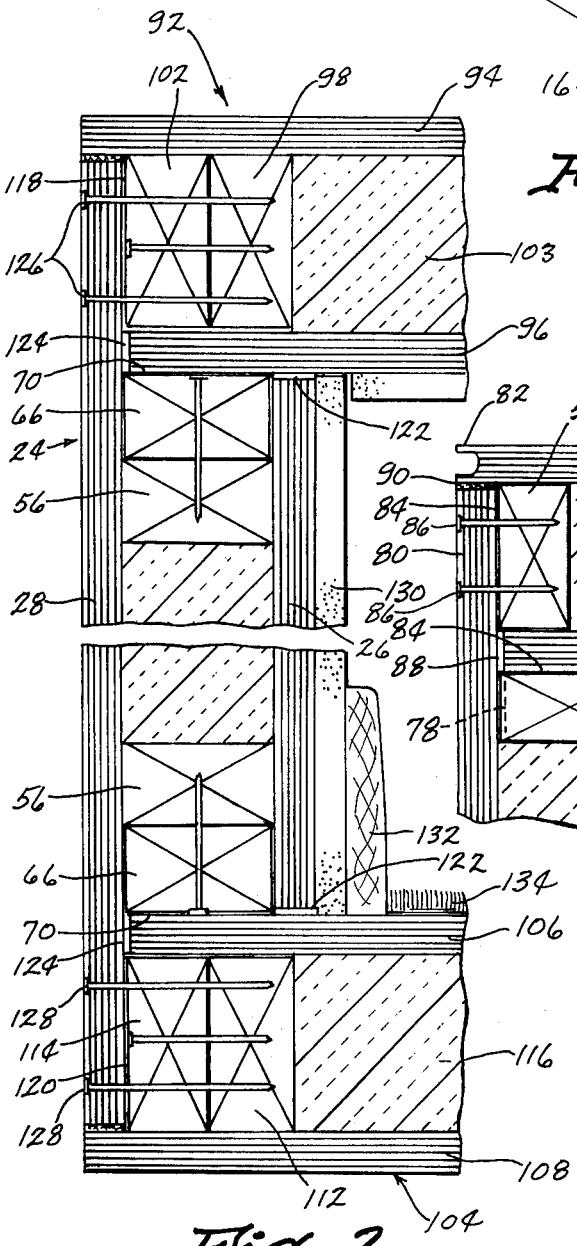
FIGS. 2, 3 and 4 are sectional views taken along lines 2—2, 3—3, and 4—4 of FIG. 1.

Referring to FIG. 2, wall panel 24 is joined to ceiling panel 92 and floor panel 104 by virtue of a pair of L-shaped glue joints. One of these glue joints is formed by the uppermost surface 70 of wall stretcher 66 and also by the outwardly presented surface 118 of ceiling stretcher 102. An L-shaped gluing surface is also formed between floor panel 104 and wall panel 24 by means of horizontal gluing surface 70 and a vertical gluing surface 120 on floor stretcher 114. It is important to note that the opposite ends of inner sheet member 26 in wall panel 24 are spaced from the inner sheet members 96, 106 of ceiling and floor panels 92, 104, respectively. The spaces are designated by the numerals 122 in FIG. 2. These spaces insure that adequate pressure is applied betwen inner sheet members 96, 106 and gluing surfaces 70. Similarly, the ends of inner sheet members 96, 106 are spaced from outer sheet member 28 of wall panel 24, and said spaces are indicated by the numerals 124. These spaces 124 insure that outer sheet member 28 can be pressed tightly against gluing surfaces 118, 120 of ceiling and floor stretchers 102, 114. Spikes or nails 126 extend through outer sheet member 28 and through ceiling stretcher 102 and ceiling panel stretcher 98. Similarly spikes or nails 128 extend through outer sheet member 28 and into floor stretcher 114 and floor panel stretcher 112. The interior surfaces of sheet members 96, 26, and 106 are covered with various interior finishing materials including gypsum board 130, woodwork 132, and carpet 134.

Figure 4:
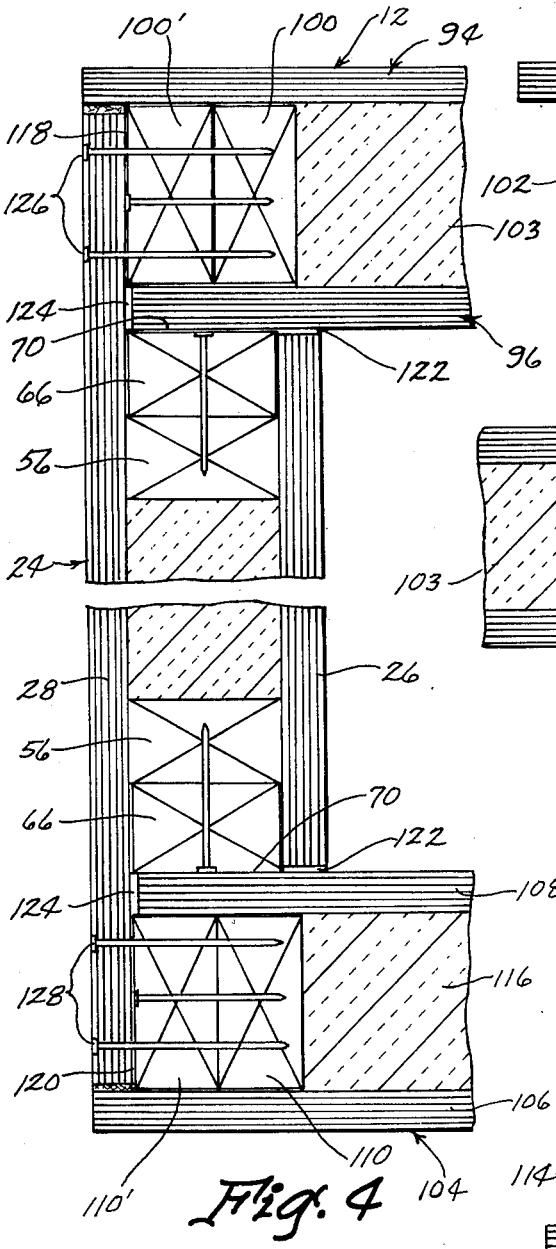

Referring to FIG. 4, the juncture between the end edges of ceiling 12, wall panel 24, and floor panel 104 are shown. FIG. 4 appears identical to FIG. 2 with the exception that double ceiling stringers 100, 100′ and double floor stringers 110, 110′ are used in the place of the stretchers shown in FIG. 2. All other parts correspond.

The building structure of the present invention is capable of withstanding shipping without serious damage. It has been found that the unit 10 can be lifted by suspension at opposite ends thereof with no noticeable deflection therebetween. Furthermore, during tests conducted, it has been found that little or no distortion or misalignment of any of the walls of the unit occur during shipping. The interior finish surface of the unit remains intact with little or no cracking of corner joints and other delicate structures within the unit. For example, shipments made with ceramic tile on the interior walls of the unit have resulted in no cracking of the grouting between the ceramic tile.

The L-shaped joints at the corners not only provide structural integrity but also increase the ability of the unit to maintain a water tight integrity. It is believed that an important factor in the structural strength of the corner joints is the fact that the edges of the sheet members do not interfere with the engagement of the glue surfaces. It is easy to apply pressure to the glued surfaces so as to provide a continuous and complete glued surface along the length thereof. In prior devices utilizing laminated panels, one of the problems encountered was the interference of the outer sheet members with the glue surfaces, and it has been extremely difficult to obtain through adhesion along the entire length of the glued surfaces.

Another advantage obtained by the present invention is the ease with which the components may be assembled. The various panel members may be constructed separately and will fit easily together. In prior devices utilizing splines for interconnecting the sheet members, considerable difficulty has been obtained in fitting the various panel members together in edge to edge relationship and also in the corner joints. The present construction, however, does not require any close fits and accordingly the various components may be pressed together for solid glue lines which insure the structural integrity of the unit.

Another advantage obtained by the present invention is the utilization of a minimum of materials while at the same time obtaining strength which is equal to or greater than prior devices. For example, with the present invention it is possible to utilize ¾-inch plywood for sheet members in the various panels whereas in prior art devices the thickness of these sheet members has been approximately 1⅛-inches. Even though thinner sheet members are used in the present invention, it is believed that a superior strength is obtained in the overall unit resulting in less deflection whenever a load is placed on any of the panels.

While any of a number of adhesives may be utilized without detracting from the invention, a preferred adhesive is a phenal resoursenal adhesive which is a two-part adhesive commonly used in woodworking. An example of such an adhesive is sold by Koppers Company, Inc., Pittsburgh, Pa., under the trade name Penacolite. Adhesives bearing the model numbers G-4411, G-4422 and G-4433 have been used successfully in the application of the present invention.

Thus it can be seen that the device accomplishes at least all of its stated objectives.

What is claimed is:

1. A building structure comprising a rectangular box having ceiling and floor walls, and four upstanding walls;

a first rectangular panel in one of said walls, a second rectangular panel in another of said walls, each of said panels comprising inner and outer rigid sheet members spaced apart in parallel relationship, said sheet members having interior surfaces facing each other and exterior surfaces, one edge of said outer sheet member extending beyond one edge of said inner sheet member so as to form a protruding flange portion;

at least one frame member in each of said panels operatively secured between said inner and outer sheet members, said frame member having a protruding surface extending beyond said one edge of said inner sheet member along a substantial portion of the length thereof;

said first and second panels being joined together in a perpendicular joint with said frame member protruding surface of said first panel engaging and being operatively secured to said flange portion of said second panel and said frame member protruding surface of said second panel engaging and being operatively secured to said inner sheet member of said first panel.

2. A building structure according to claim 1 wherein an adhesive is between said engaging surfaces of said first panel frame member and said flange portion of second panel, an adhesive also being between said engaging surfaces of said second panel frame member and said first panel inner sheet member.

3. A building structure according to claim 2 wherein spikes extend through said outer sheet member of said second panel and into said frame member of said first panel.

4. A building structure according to claim 1 wherein said edges of said second panel inner and outer sheet members are adjacent and spaced a predetermined distance from said outer and inner sheet members respectively of said first panel.

5. A building structure according to claim 4 wherein a caulking compound is within said spaces between the edges of said first panel sheet members and the inner and outer sheet members of said second panel members.

6. A building structure according to claim 5 wherein said predetermined distances are approximately ⅛ of an inch.

7. A building structure according to claim 1 wherein said first panel includes a rectangular panel frame operatively secured between said sheet members, said rectangular frame comprising a pair of spaced apart panel stringers and a pair of horizontal spaced apart panel stretchers, said panel stringers and panel stretchers being parallel to and spaced inwardly from the edges of said sheet members.

8. A building structure according to claim 7 wherein a third panel identical to said first panel is positioned in the same plane as said first panel and with said panel stretchers of said first and third panels in longitudinal alignment with one another.

9. A building structure according to claim 8 wherein said sheet members of said first and third panels include lateral edges in abutting engagement so that said first and third panels are joined to form a continuous wall, said one frame member comprising a wall stretcher extending between said sheet members of both of said first and third panels and being operatively secured to said aligned panel stretchers of said first and third panels so as to secure said first and third panels into an integral unit.

10. A building structure according to claim 9 wherein said abutting edges of said sheet members comprise mating tongue and groove portions which are joined together by an adhesive material.

11. A building structure comprising a rectangular box having ceiling and floor walls and four upstanding walls;

each of said walls comprising a plurality of rectangular panels;

said panels each comprising inner and outer rectangular rigid sheet members spaced apart in parallel relation and having opposite end edges and opposite lateral edges, a rectangular frame being operatively secured to both of said sheet members therebetween so as to hold said sheet members together;

said rectangular frames each having opposite parallel end panel stretcher members extending parallel to said end edges of said sheet members and being spaced inwardly from said end edges;

said rectangular frames also each having opposite and parallel panel stringer members spaced inwardly from said lateral end edges of said sheet members and extending parallel thereto;

each of said walls being formed by said plurality of sheet members being positioned in side by side relation with said lateral edges of said sheet members in abutting relationship and with said end panel stretcher members in longitudinal alignment with one another;

a pair of elongated wall stretchers extending along said longitudinally aligned panel stretchers respectively and being operatively secured thereto so as to lock said panels together in side by side relationship;

said wall stretchers being embraced between said inner and outer sheet members of said panels;

said upstanding walls each having one of said wall stretchers therein in engagement with and operatively secured to said inner sheet member of said ceiling wall and the other of said wall stretchers in engagement with and operatively secured to said inner sheet member of said floor wall;

said floor wall having each of said wall stretchers therein in engagement with and operatively secured to said outer sheet member of one of said upstanding walls; and said ceiling wall having each of said wall stretchers therein in engagement with and operatively secured to said outer sheet member of one of said upstanding walls.

12. A building structure according to claim 11 wherein one of said stringers of each panel is spaced inwardly a first predetermined position from one of said lateral edges of said sheet members and the other of said stringers is spaced inwardly a second predetermined distance from the other of said lateral edges of said sheet members.

13. A building structure according to claim 11 wherein a layer of foamed plastic insulation material is positioned between said sheet members, said plastic material being free floating within said sheet members and free from connection thereto.

* * * * *